US005435744A

United States Patent [19]

Derstine et al.

[11] Patent Number: 5,435,744

[45] Date of Patent: Jul. 25, 1995

[54] SLIDING BOOT ASSEMBLY FOR ELECTRICAL CONNECTOR

[75] Inventors: Michael P. Derstine; David M. Wolla, both of Winston-Salem, N.C.

[73] Assignee: The Whitaker Corporation, Wilmington, Del.

[21] Appl. No.: 245,939

[22] Filed: May 19, 1994

[51] Int. Cl.[6] ..... H01R 13/627

[52] U.S. Cl. ..... 439/352

[58] Field of Search ..... 439/352, 350, 351, 353–358

[56] References Cited

U.S. PATENT DOCUMENTS

| | | | |
|---|---|---|---|
| 4,762,505 | 8/1988 | Asick et al. | 439/347 |
| 4,838,808 | 6/1989 | Fujiura | 439/352 |
| 4,954,097 | 9/1990 | Sekiguchi | 439/352 |
| 5,011,424 | 4/1991 | Simmons | 439/352 |
| 5,041,025 | 8/1991 | Haitmanek | 439/681 |
| 5,167,523 | 12/1992 | Crimmins et al. | 439/350 |
| 5,171,161 | 12/1992 | Kachlic | 439/701 |

FOREIGN PATENT DOCUMENTS

| | | | |
|---|---|---|---|
| 40874 | 2/1990 | Japan | 439/352 |

*Primary Examiner*—Gary F. Paumen
*Attorney, Agent, or Firm*—William B. Noll

[57] ABSTRACT

This invention is directed to an electrical cable connector of the type for mating with and latchably engaging a complementary connector. The connector typically includes a dielectric housing containing an array of electrical contacts for electrical engagement with respective contacts in a complementary connector. The connector further comprises a pair of unitary metal shielding members stamped and formed from a metal sheet blank, where a first of the shielding members includes a pair of reversely bent latching arms extending from a mating end toward a cable receiving end, and a pair of hermaphroditic cover members formed of a dielectric material adapted to interfit together about the electrical connector in sliding engagement therewith, and movable from a first position to a second position to effect unmating of said electrical connector from the header assembly. Each cover member includes a latching arm receiving recess, and a flexible arm engageable with a complementary recess in the opposing cover member. Manual movement of the assembled cover members to the second position causes the respective flexible arms to flex from their resiled position. Releasing the assembled cover members effects a return of the assembled cover members to the first position.

8 Claims, 6 Drawing Sheets

SLIDING BOOT ASSEMBLY FOR ELECTRICAL CONNECTOR

RELATED APPLICATION

The invention hereof, directed to a sliding boot assembly for an electrical cable connector, represents an alternative to the invention disclosed in copending application, U.S. Ser. No. 08/093,543, filed Jul. 16, 1993, and assigned to the assignee hereof.

BACKGROUND OF THE INVENTION

This invention relates to an electrical cable connector of the type for mating with a complementary header assembly, where the connector is provided with an overlying sliding boot assembly or cover disengaging the connector from such header assembly.

A common feature of prior art devices of this type is the provision of a pair of opposing latching members which must be grasped and squeezed to effect unmating of the connector from a complementary connector or a header assembly. A recent example thereof is disclosed in U.S. Pat. No. 5,167,523. Briefly, the invention thereof is directed to a connector comprising a housing having a cable receiving end and a connector receiving end; and relatively heavy gauge metal latching arms located along lateral sides of the housing. The latching arms are provided with engaging ends with hooking tabs for engaging a complementary electrical connector, and actuator ends for finger grasping to actuate movement of the engaging ends of the latching arms. Further means are included for pivoting the latching arms around pivot points located between the engaging ends and the actuator ends.

The manner by which the present invention achieves the objectives hereof, particularly the unmating or release mechanism, and how the system hereof differs from that of the copending application, will become apparent to those skilled in the art from reading these specifications, particularly when read in conjunction with the accompanying drawings.

DETAILED DESCRIPTION OF THE PREFERRED EMBODIMENT

The present invention is directed to a sliding boot assembly for an electrical connector of the type to be mated to a complementary header assembly, where the sliding action of the boot assembly can be used to effect unmating without having to manually squeeze opposed latching members as required by the prior art.

Figure 1:
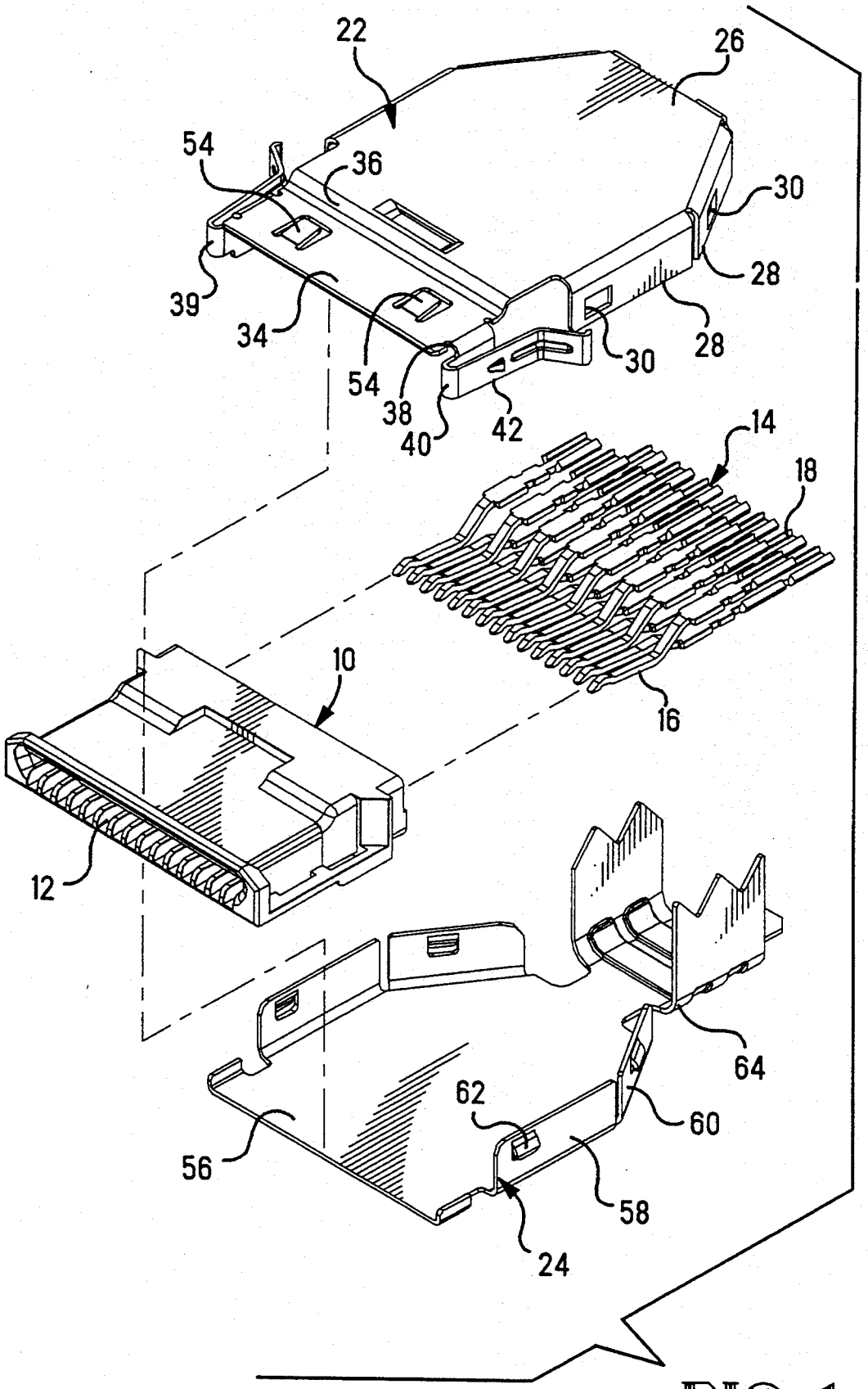
FIG. 1 is an exploded perspective view of a typical electrical connector, and modified metal shielding members, matable with a complementary header assembly, which the connector is to be provided with an overlying sliding boot assembly to effect disengagement of the connector from the header assembly.

A typical electrical connector suitable for practicing this invention, less the sliding boot assembly, is illustrated in FIG. 1. Such connector includes a dielectric housing 10 having a plurality of cavities or slots 12 to receive or support an array of electrical contact 14 therein. The contacts 14, as known in the art, typically include a contact portion 16 and a conductor terminating portion 18, where in this case the wires of a multi-conductor cable 20 (FIG. 2) may be terminated thereto.

Overriding and in intimate contact with the housing 10 are a pair of interfitting shielding members consisting of a top member 22 and a bottom member 24. By way of example, the top member 22 or shell is a unitary member stamped and formed from a metal sheet blank. The top member 22 comprises a rearward planar portion 26 and depending side walls 28, where each wall 28 may be provided with an inwardly directed lance 30 struck from the wall thereof. While the lance has been shown in the upper or top member 22, it should be understood that the lance may well be provided in the bottom member 24.

Figure 4:
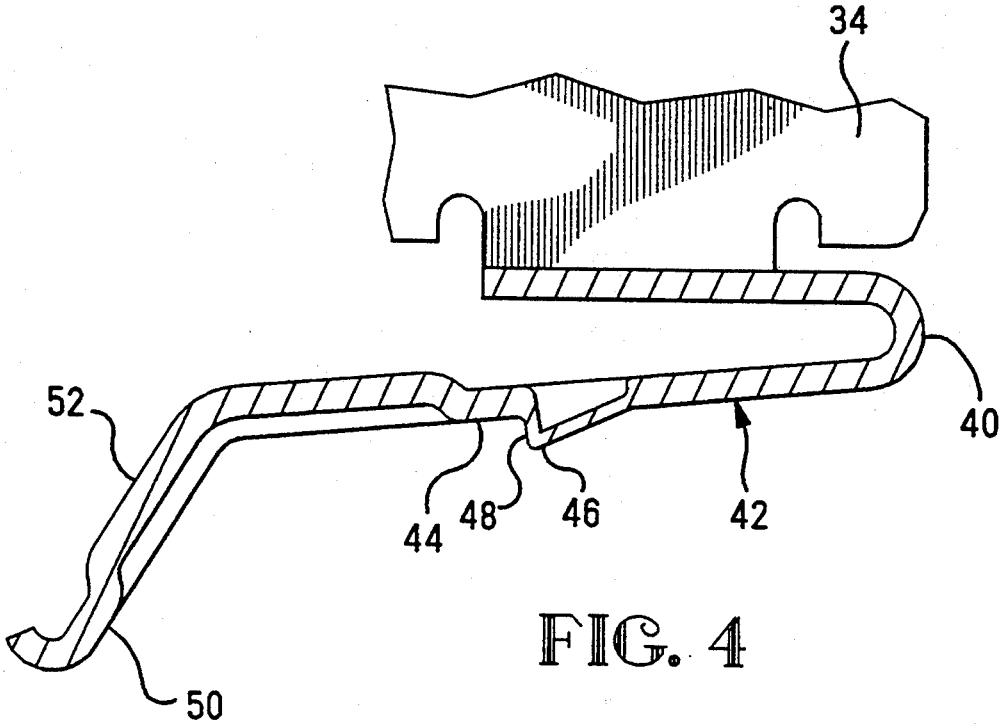
FIG. 4 is an enlarged sectional view, taken horizontally therethrough, of the latching member to be latched with a complementary header assembly.

The mating end 32 of the top portion includes a forward planar portion 34 joined to said rearward planar portion 26 by a sloped transition portion 36. Depending from the edges 38 of the forward planar portion are a pair of side walls 39, where each wall 39, from a front edge 40 thereof, includes a reversely bent latching arm 42, see also FIG. 4. The latching arm 42, reversely bent from the front edge 40, includes a generally rearwardly directed arm portion 44 having an embossed dimple 46, with a flat rear surface 48, and an outwardly extending arm portion 50. For stiffening purposes, the latching arm 42 may be provided with an embossed or added rib 52 at the junction of the respective arm portions. Finally, the forward planar portion 34 may include plural lances 54 struck outwardly thereof to provide grounding of the shield to the shield of a complementary header assembly, not shown.

The bottom member 24 is also a metal member stamped and formed from a sheet metal blank, as known and practiced in the art. Such bottom member 24 comprises a bottom wall 56 and plural upstanding side walls 58, 60, where the side walls 58 includes windows 62 positioned to receive respective inwardly directed lances 30 when the bottom member 24 is interfitted with the top member 22. Projecting rearwardly from the bottom wall 56 is a cable relief portion 64 to be wrapped around the cable in a manner known in the art. However, as noted previously, the window 62 and complementary lance may be switched between the respective shielding members.

Figure 2:
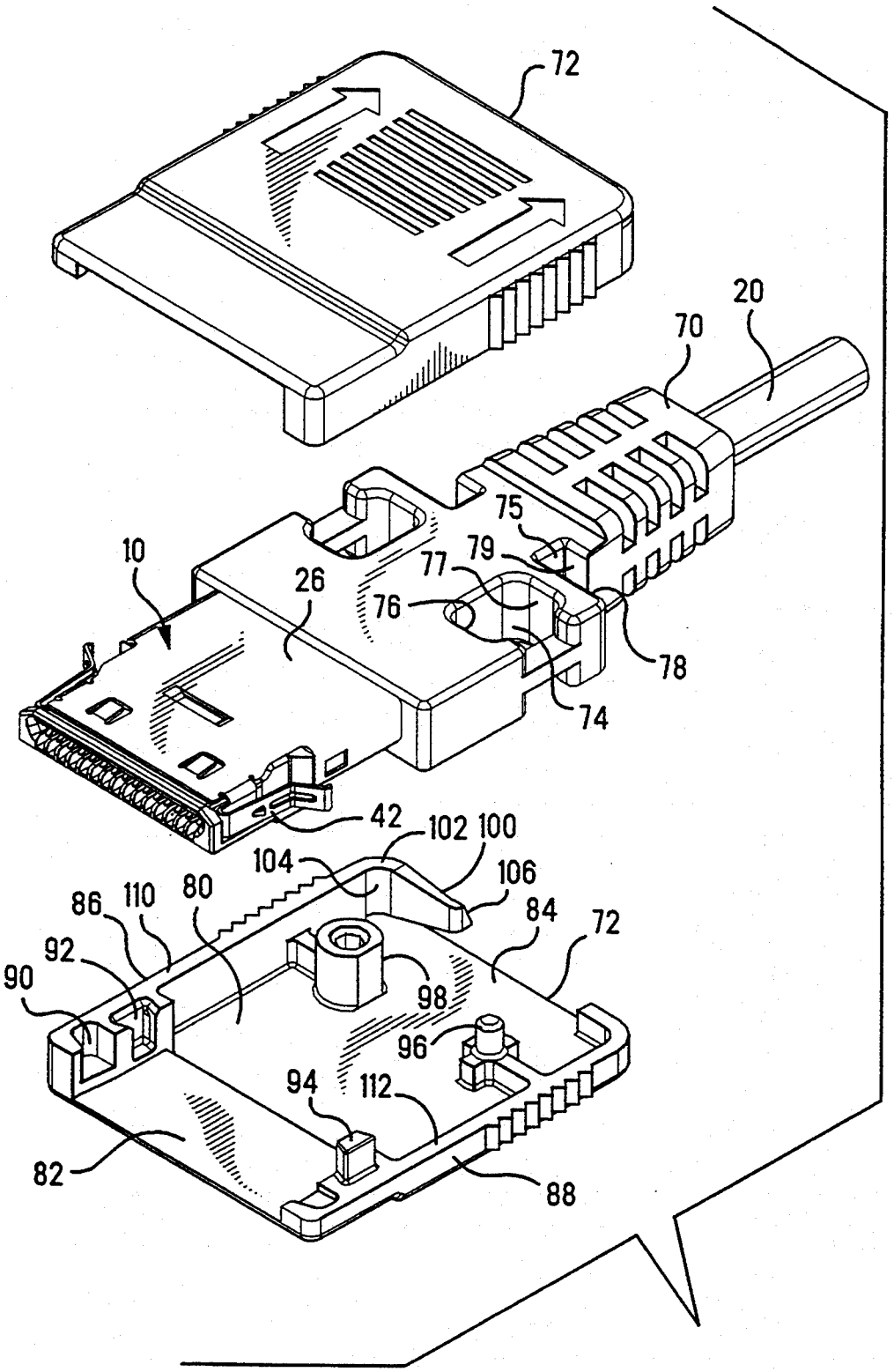
FIG. 2 is an exploded perspective view of the assembled electrical connector, including a multi-wire cable, joined thereto for example, and a pair of hermaphroditic cover members, which when assembled about the connector are in sliding engagement therewith.

FIG. 2 illustrates the assembled electrical connector of FIG. 1, including a post molded cable assembly 70, and a pair of hermaphroditic boot assembly members 72 prior to engagement with the assembled electrical connector. The post molded cable assembly 70, extending between the dielectric housing 10 and the insulated cable 20, includes a pair of opposed through openings 74, longitudinally defined by front and rear walls 76, 77, respectively. Spaced rearwardly from said openings 74 are a pair of opposing recesses 75 extending longitudinally between a forward wall 78 and a rear wall 79.

The pair of first and second hermaphroditic boot assembly members 72 are adapted to close together, with one member serving as a cover to the other member. Hereafter, a description of one such member will apply to both. Each assembly member is fabricated, preferably by injection molding, from an insulating material, such as plastic. The assembly member 72 comprises a base 80, having first and second stepped portions 82, 84, a major side wall 86 and an opposing minor wall 88. At the side of the second stepped portion 82, the major side wall 86 includes a pair of recesses 90, 92, where the end most recess 90 is adapted to receive the latching arm portion 50 in a manner to be described hereinafter. The adjacent recess 92 is a contoured recess to receive a complementary post 94 projecting from the minor side wall 88 of the complementary assembly member 72. Interiorly, the assembly member 72 is provided with a post 96 and socket 98, where the post of one member 72 is received in the socket of the other. A final feature of the assembly member 72 is the provision of a flexible arm 100 extending transversely from the end 102 of the major side wall 86. That is, the flexible arm 100 is secured, i.e. integrally molded thereto, to the major side wall 86 at its base 104. At the free end of the flexible arm 100, a tapered projection 106 is provided, where such projection is generally rearwardly.

Figure 3B:
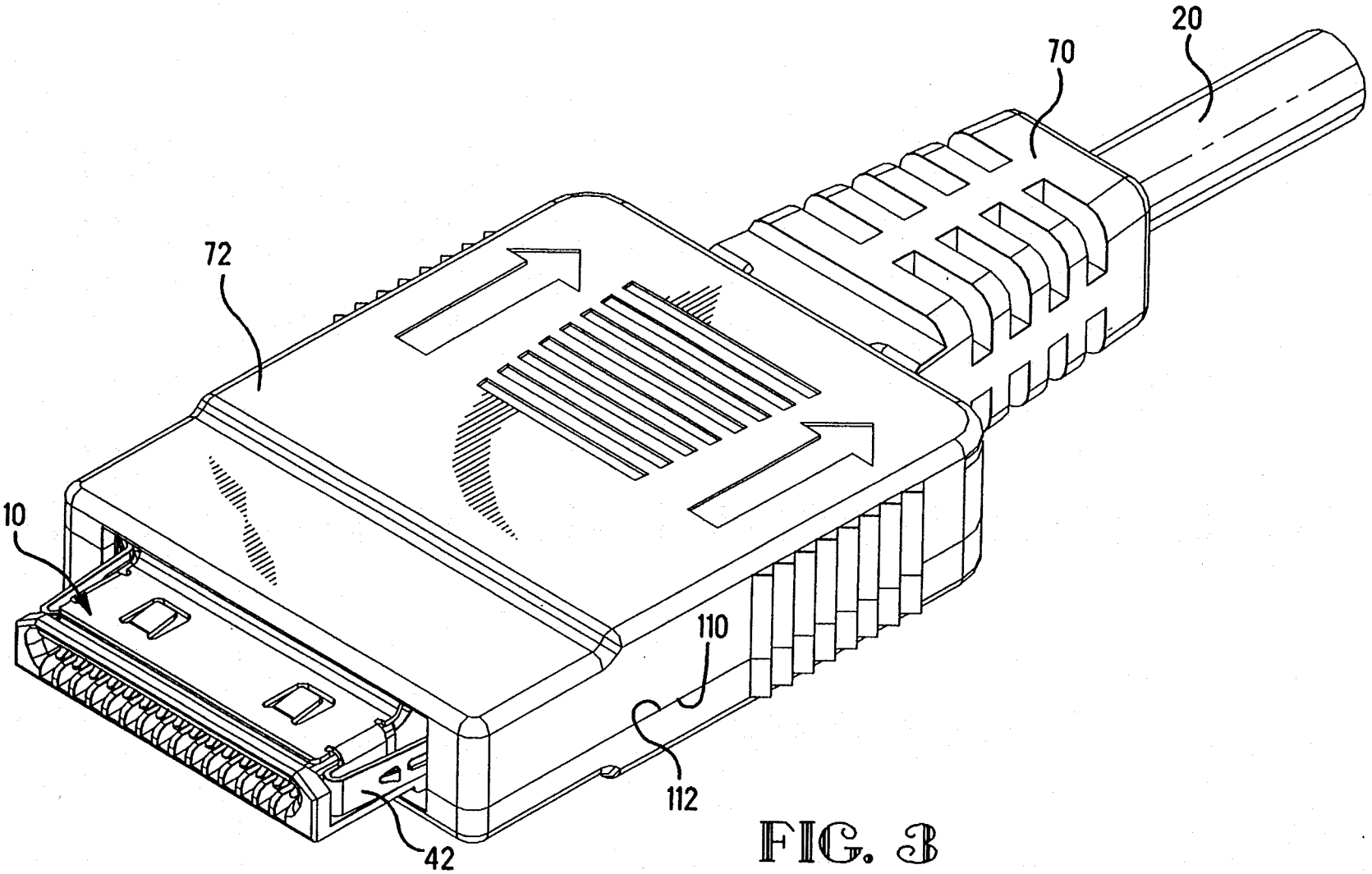
FIG. 3 is a perspective view of the assembled connector and cover members of FIG. 2.
Figure 5:
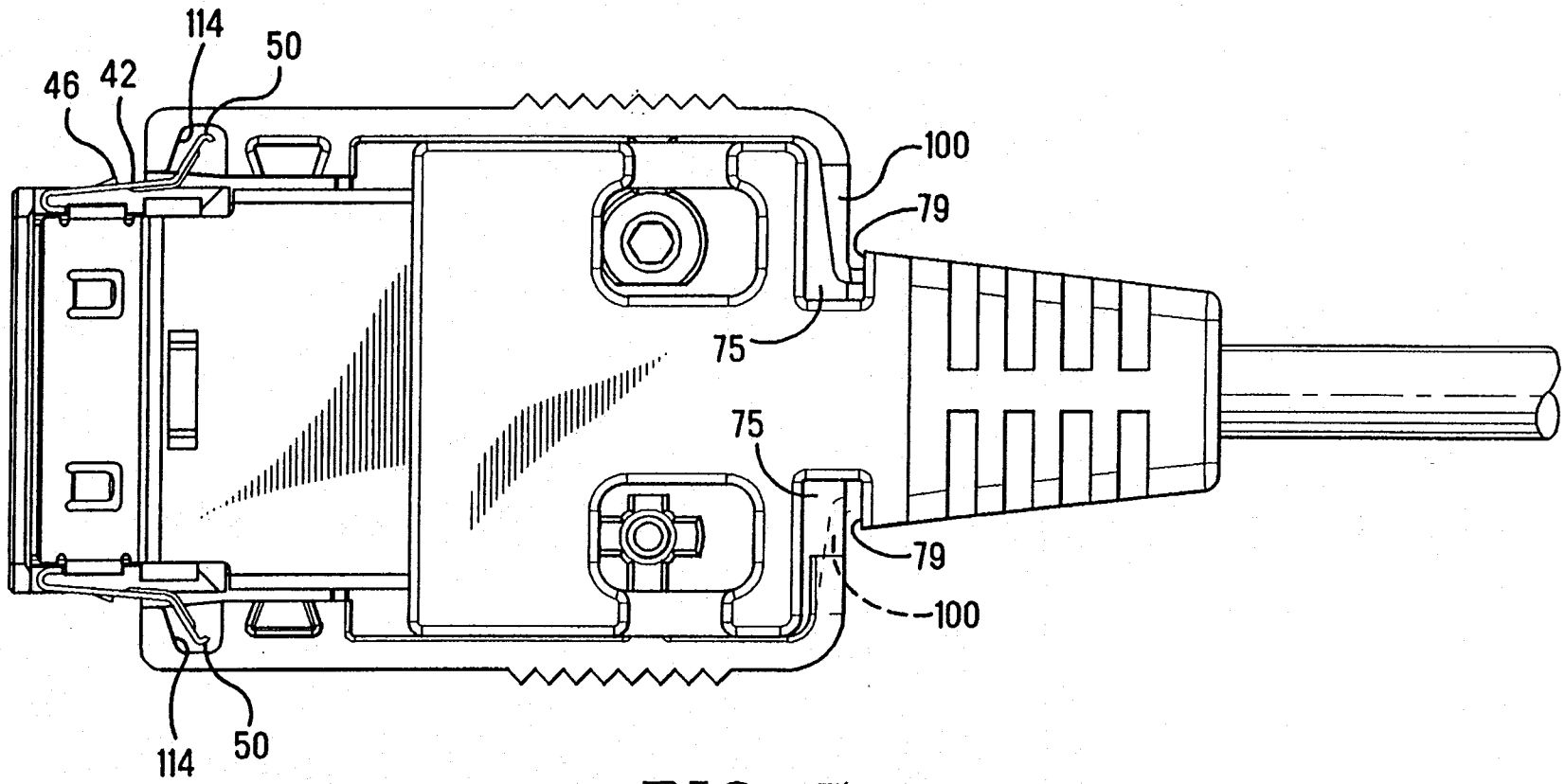
FIG. 5 is a sectional view taken through the assembly of FIG. 3, showing the latched position thereof, illustrating the relative position of the connector components before or after mating with a complementary header assembly.
Figure 6:
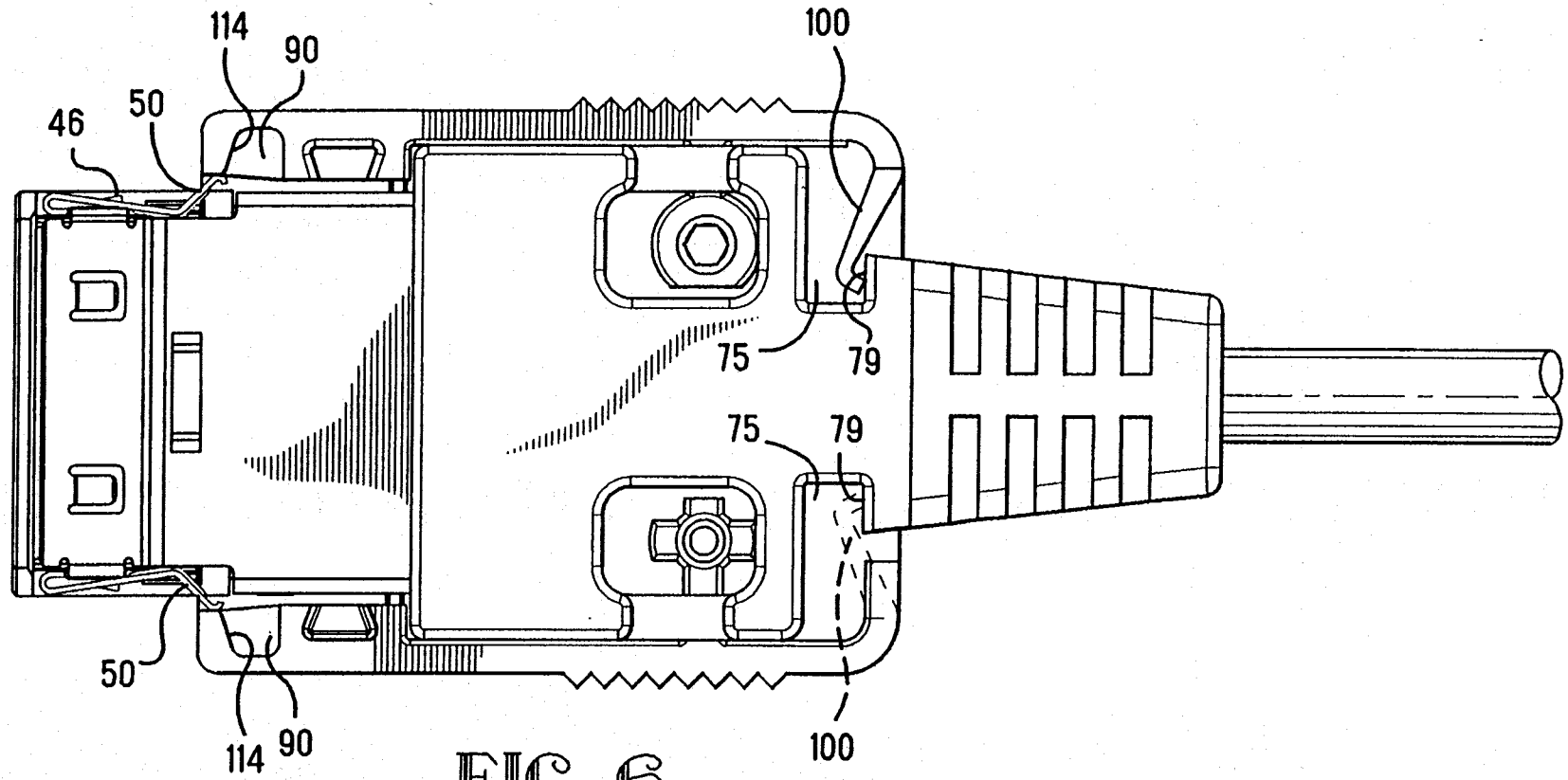
FIG. 6 is a sectional view similar to FIG. 5, showing the relative position of the respective components during the unmating action from the complementary header assembly.

When the boot assembly members are interfitted over the molded cable assembly 70 in the manner illustrated in FIG. 3, and particularly in the sectioned views of FIGS. 5 and 6, the flexible arms 100 are received in the respective recesses 75, where the projections 106 contact rear wall 79. Additionally, the complementary posts 96 and sockets 98 are respectively mated in a snugly fitting relationship, where the edge 110 of the major wall 86 of one assembly member 72 lies adjacent and in contact with the edge 112 of minor wall 88 of the other assembly member, see FIG. 3, and the respective posts 94 slidably engage with recess 92 of the other assembly member.

Turning specifically to the sequence of FIGS. 5 and 6, the former Figure represents the position of mating, where the latching arms 42 are extended or relaxed and the embossed dimple 46 is suitably engaged in a corresponding slot in the mated header assembly, not shown. As the boot assembly is moved rearward, see FIG. 6, the outwardly extending arm portion 50 is cammed inwardly by action of the forward wall 114 of recess 90. This releases or frees the embossed dimple 46 from contact with the header assembly thereby allowing for the unmating thereof from the connector of this invention. Concurrently with the movement of the boot assembly, the respective flexible arms 100 are flexed in the manner illustrated in FIG. 6. With the unmating accomplished, the boot assembly is released to return to the position shown in FIG. 5. This return is caused by the flexible arms 100 resiling back to their normal or unflexed position, i.e. pushing against the rear wall 79 of recess 75. In this mating and unmating relationship, the arm portion 50 remains within the boot assembly members.

We claim:

1. An electrical cable connector of the type for mating with and latchably engaging a complementary header assembly, where said connector includes a dielectric housing containing a plurality of cavities or slots for supporting or receiving an array of electrical contacts for electrical engagement with respective contacts in said header assembly, and said electrical contacts include conductor terminating portions for engaging the respective conductors of a cable, said connector comprising the combination of a pair of unitary metal shielding members stamped and formed from a metal sheet blank, where a first of said shielding members includes a pair of reversely bent latching arms extending from a mating end toward a cable receiving end, and a pair of hermaphroditic cover members formed of a dielectric material adapted to interfit together about the electrical connector in sliding engagement therewith from a first position to a second position to effect unmating of said electrical connector from said header assembly, each said cover member including a latching arm receiving recess having a camming surface to effect bending of said arms during movement of the assembled cover members, and a flexible arm engageable with a complementary recess in the opposing cover member, whereby movement of the assembled cover members to said second position to effect said unmating causes the respective flexible arms to flex from their resiled position, and that releasing the assembled cover members, through the action of said flexible arms, to return the assembled cover members to said first position.

2. The electrical cable connector according to claim 1, wherein said pair of unitary metal shielding members are interfitted to provide full shielding thereabout.

3. The electrical cable connector according to claim 2, wherein one of said metal shielding members includes plural lances struck from the metal thereof to effect grounding contact with the metal shield of said header assembly.

4. The electrical cable connector according to claim 1, wherein each said latching arm includes an embossed projection having a shoulder thereon to engage a suitable recess in said header assembly.

5. The electrical cable connector according to claim 4, wherein said camming surface is angled to effect movement of said latching arm when the assembled cover members are moved from said first position to said second position.

6. The electrical cable connector according to claim 4, wherein one of said metal shielding members includes two sections angularly disposed to one another, and a stiffening member traversing at least a portion of each said section.

7. The electrical cable connector according to claim 2, wherein a wall of one of said shielding members includes a lance struck therefrom for mating with a complementary window or slot in the other of said shielding members.

8. The electrical cable connector according to claim 1, wherein the portion of said latching arm to be cammed by said cover member is fully contained within said cover member.

* * * * *